US009679709B2

(12) United States Patent
Rojko

(10) Patent No.: US 9,679,709 B2
(45) Date of Patent: Jun. 13, 2017

(54) DEVICES AND METHODS FOR ACTIVATING CIRCUIT BREAKER ACCESSORIES

(75) Inventor: Jan Rojko, Conyers, GA (US)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 129 days.

(21) Appl. No.: 14/373,677

(22) PCT Filed: May 2, 2012

(86) PCT No.: PCT/US2012/036097

§ 371 (c)(1),
(2), (4) Date: Aug. 11, 2014

(87) PCT Pub. No.: WO2013/165409

PCT Pub. Date: Nov. 7, 2013

(65) Prior Publication Data

US 2015/0053541 A1 Feb. 26, 2015

(51) Int. Cl.
*H01H 85/32* (2006.01)
*H01H 3/04* (2006.01)
(Continued)

(52) U.S. Cl.
CPC ..... *H01H 3/04* (2013.01); *H01H 3/46* (2013.01); *H01H 71/10* (2013.01); *H01H 89/00* (2013.01); *H01H 2235/01* (2013.01)

(58) Field of Classification Search
CPC ..... H01H 3/04; H01H 3/46; H01H 71/10; H01H 89/00; H01H 2235/01
(Continued)

(56) References Cited

U.S. PATENT DOCUMENTS 3,349,207 A * 10/1967 Gratzmuller ..... H01H 3/40 200/82 B
4,301,433 A 11/1981 Castonguay et al.
(Continued)

FOREIGN PATENT DOCUMENTS

CN 1056372 A 11/1991
CN 1070765 A 4/1993
JP H08335433 A 12/1996

OTHER PUBLICATIONS

Written Opinion of the International Searching Authority PCT/ISA/237 for International Application No. PCT/SE2012/036097 dated May 2, 2012.

(Continued)

*Primary Examiner* — Steven Lim
*Assistant Examiner* — Mancil Littlejohn, Jr.
(74) *Attorney, Agent, or Firm* — Harness, Dickey & Pierce, PLC

(57) ABSTRACT

A device is provided for use with a circuit breaker that includes an actuator adapted to move in a first direction in response to an over-current and/or a short circuit condition, and a circuit breaker accessory that includes an actuation mechanism. The device includes a linkage having a first end adapted to be coupled to the actuator and a second end adapted to be disposed adjacent the actuation mechanism. Movement of the actuator in the first direction allows the linkage to move in a second direction different from the first direction from a first position to a second position to activate the circuit breaker accessory. Numerous other aspects are provided.

35 Claims, 4 Drawing Sheets

(51) Int. Cl.
*H01H 71/10* (2006.01)
*H01H 3/46* (2006.01)
*H01H 89/00* (2006.01)

(58) Field of Classification Search
USPC ..... 340/638; 335/6–11, 21–23, 35–37, 43, 335/132, 172; 200/76, 77, 78, 293, 323, 200/324, 325; 337/6, 7, 146
See application file for complete search history.

(56) References Cited

U.S. PATENT DOCUMENTS 5,192,941 A * 3/1993 Fishovitz ..... H01H 71/46 335/17
2008/0237192 A1* 10/2008 Whitaker ..... H01H 9/02 218/146

OTHER PUBLICATIONS

Chinese Office Action and English translation thereof dated Mar. 1, 2016.

* cited by examiner

DEVICES AND METHODS FOR ACTIVATING CIRCUIT BREAKER ACCESSORIES

PRIORITY STATEMENT

This application is the national phase under 35 U.S.C. §371 of PCT International Application No. PCT/US2012/036097 which has an International filing date of May 2, 2012, which designated the United States of America, the entire contents of which is hereby incorporated herein by reference.

FIELD

At least one embodiment of the invention relates generally to circuit breakers, and more particularly to devices and methods for activating circuit breaker accessories.

BACKGROUND

Circuit breakers typically include one or more electrical contacts, and provide protection against persistent over-current conditions and short circuit conditions. In particular, many circuit breakers include a trip unit that includes one or more trip bars that release a trip mechanism on persistent over-current conditions and short circuit conditions to trip the circuit breaker and open the electrical contacts to stop the flow of current in the protected circuit.

In addition, many circuit breakers include one or more accessory compartments into which one or more accessories may be installed. Accessories are often used to provide additional functional capabilities to a circuit breaker. For example, a trip alarm switch accessory may be configured to sound an alarm when the circuit breaker trips to notify personnel that a fault has occurred. Other accessories may be configured to perform other functions on the occurrence of a fault or other operating condition. Circuit breaker accessories typically include an actuation mechanism (e.g., a switch, a push-button, a plunger, etc.), that is configured to be engaged by an actuator on the trip unit (e.g., an extension arm on the trip bar), such that on the occurrence of a fault, the trip unit actuator engages the accessory actuation mechanism. For example, on the occurrence of a fault, a trip bar extension arm may compress a plunger on a trip alarm switch accessory, causing the alarm to sound.

However, in many circuit breakers, available space for accessory compartments may be quite limited, and installed accessories often are surrounded by numerous other components in the circuit breaker. As a result, the actuation mechanism for some accessories may not be located near exiting trip unit actuators, or may be obstructed by other circuit breaker components, such that the accessory cannot be used in the circuit breaker.

SUMMARY

In a first embodiment, a device is provided for use with a circuit breaker that includes an actuator adapted to move in a first direction in response to an over-current and/or a short circuit condition, and a circuit breaker accessory that includes an actuation mechanism. The device includes a linkage having a first end adapted to be coupled to the actuator and a second end adapted to be disposed adjacent the actuation mechanism. Movement of the actuator in the first direction allows the linkage to move in a second direction different from the first direction from, a first position to a second position to activate the circuit breaker accessory.

In a second embodiment, a modular accessory is provided for use with a circuit breaker that includes an actuator adapted to move in a first direction in response to an over-current and/or a short circuit condition. The modular accessory includes an actuation mechanism and a linkage having a first end adapted to be coupled to the actuator and a second end disposed adjacent the actuation mechanism. Movement of the actuator in the first direction allows the linkage to move in a second direction different from the first direction, from a first position to a second position to activate the circuit breaker accessory.

In a third embodiment, a circuit breaker is provided that includes an actuator, a circuit breaker accessory having an actuation mechanism, and a linkage having a first end coupled to the actuator and a second end disposed adjacent the actuation mechanism. The actuator is adapted to move in a first direction in response to an over-current and/or a short circuit condition. Movement of the actuator in the first direction allows the linkage to move in a second direction different from the first direction, from a first position to a second position to activate the circuit breaker accessory.

In a fourth embodiment, a method is provided for use with a circuit breaker that includes an actuator adapted to move in a first direction in response to an over-current and/or a short circuit condition, and a circuit breaker accessory that includes an actuation mechanism. The method includes providing a linkage having a first end coupled to the actuator and a second end adapted to be disposed adjacent the actuation mechanism, and moving the linkage in a second direction different from the first direction from a first position to a second position to activate the circuit breaker accessory in response to movement of the actuator in the first direction. Numerous other embodiments are provided.

BRIEF DESCRIPTION OF THE DRAWINGS

Features of the present invention can be more clearly understood from the following detailed description of example embodiments considered in conjunction with the following drawings, in which the same reference numerals denote the same elements throughout, and in which.

DETAILED DESCRIPTION OF EXAMPLE EMBODIMENTS

Devices and methods in accordance with embodiments of the invention are provided for activating circuit breaker accessories. In an example embodiment, a device is provided that includes a first lever, a second lever, and a linkage. The first lever is coupled to a circuit breaker actuator, and is fixedly coupled to the second lever. The linkage has a first end coupled to the second lever, and a second end adapted to be disposed adjacent an accessory actuation mechanism. The circuit breaker accessory may be, for example, a trip alarm switch accessory. During normal circuit breaker operation, the linkage is in a first position, the second end of the linkage does not contact the accessory actuation mechanism, and the accessory is not activated.

In response to an over-current and/or a short circuit condition, the circuit breaker actuator moves in a first direction, which allows the linkage to move in a second direction different from the first direction, from a first position to a second position. When the linkage moves to the second position, the second end of the linkage contacts the accessory actuation mechanism to activate the accessory. For example, if the accessory is a trip alarm switch accessory, the alarm will sound to indicate that a fault has occurred.

Figure 1A:
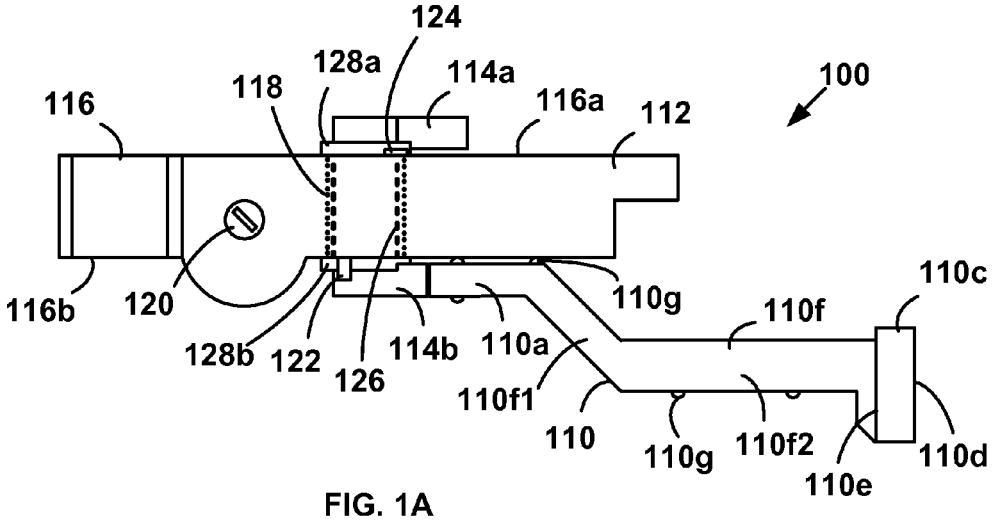
FIG. 1A is a top view of an example linkage in accordance with an embodiment of the invention.
Figure 1B:
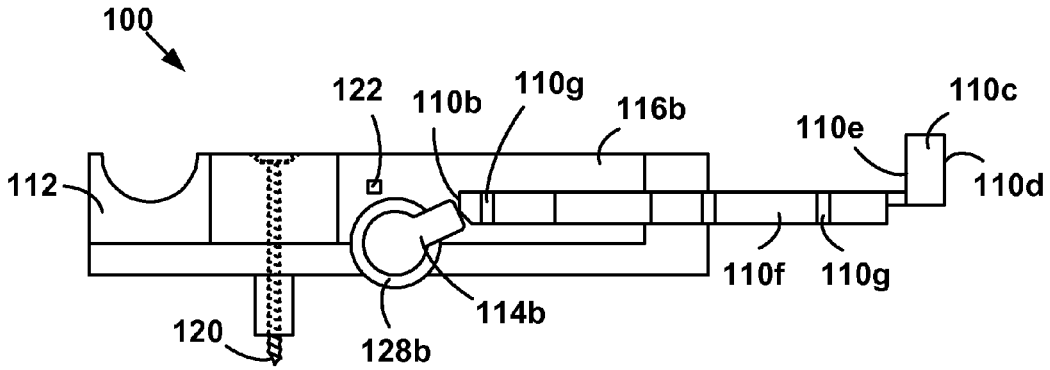
FIG. 1B is a side view of the example linkage of FIG. 1A.
Figure 1C:
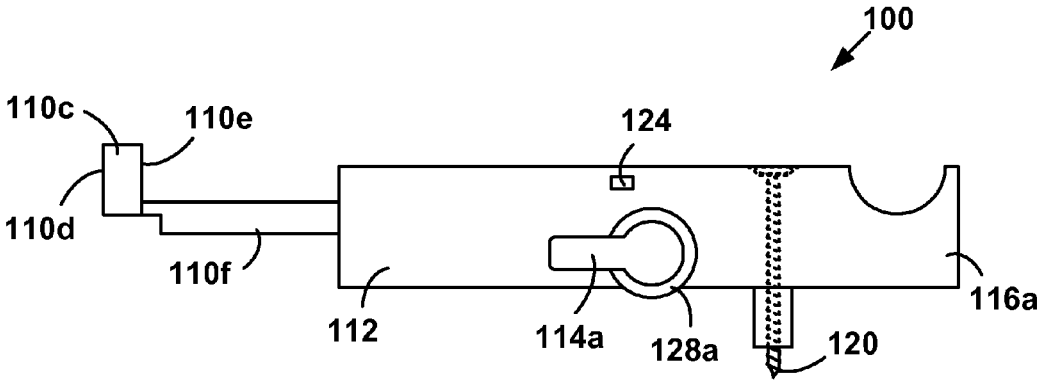
FIG. 1C is another side view of the example linkage of FIG. 1A.

Referring to FIGS. 1A-1C, an example device in accordance with an embodiment of the invention is described. Device 100 includes a linkage 110, a bushing 112, a first lever 114*a* and a second lever 114*b*. Linkage 110 includes a first end 110*a* having a first surface 110*b*, a second end 110*c* having a second surface 110*d* and a third surface 110*e*, and an intermediate portion 110*f* extending between first end 110*a* and second end 110*c*.

Intermediate portion 110*f* may include a first segment 110*f*1 and a second segment 110*f*2. First segment 110*f*1 may be oriented at an angle relative second segment 110*f*2, so that second end 110*c* is located at a predetermined location and/or a predetermined distance from bushing 112. Persons of ordinary skill in the art will understand that intermediate portion 110*f* may have more or less than two segments, and may have configurations other than the example configuration shown in FIGS. 1A-1C. Linkage 110 optionally may include one or more friction reducers 110*g* disposed on one or both sides of linkage 110.

Linkage 110 may be fabricated from a plastic, a resin, a polymer, nylon, or other similar material. In an example embodiment, linkage 110 may be fabricated from a strong, flame retardant, glass-filled nylon material, such as Ultradur® High Speed polybutylene terephthalate ("PBT") by BASF Corporation, Florham Park, N.J., USA. Linkage 110 may be fabricated by injection molding, machining, or other similar technique. Linkage 110 may have a length between about 45 mm and about 65 mm, a width between about 15 mm and about 30 mm, and a height between about 10 mm and about 20 mm. Persons of ordinary skill in the art will understand that other materials, fabrication techniques and dimensions may be used.

Bushing 112 has a first side 116*a*, a second side 116*b*, and an opening 118 that extends from first side 116*a* to second side 116*b*. Bushing 112 optionally may include a fastener 120, such as a screw or other similar fastener, for securing bushing 112 to a circuit breaker housing, or some other portion of a circuit breaker assembly. Bushing 112 also may optionally include a travel limiter 122 and a stop 124, described in more detail below.

Example bushing 112 shown in FIGS. 1A-1C includes a variety of steps, cutouts and protrusions that may be useful for accommodating bushing 112 within a cavity of a circuit breaker housing (not shown). Persons of ordinary skill in the art will understand that bushing 112 may have any of a variety of profiles, and that profiles other than that shown in FIGS. 1A-1C may be used.

Bushing 112 may be fabricated from a plastic, a resin, a polymer, nylon, or other similar material. In an example embodiment, bushing 112 may be fabricated from Ultradur High Speed PBT. Bushing 112 may be fabricated by injection molding, machining, or other similar technique. Bushing 112 may have a length between about 55 mm and about 70 mm, a width between about 5 mm and about 15 mm, and a height between about 20 mm and about 30 mm. Persons of ordinary skill in the art will understand that other materials, fabrication techniques and dimensions may be used.

First lever 114*a* is disposed on first side 116*a* of bushing 112, and second lever 114*b* is disposed on second side 116*b* of bushing 112. First lever 114*a* and second lever 114*b* are mounted on opposite ends of a cylindrical shaft 126 that extends through and freely rotates within opening 118 of bushing 112. First lever 114*a* and second lever 114*b* are fixedly coupled together via cylindrical shaft 126. Thus, rotation of first lever 114*a* causes a corresponding rotation of cylindrical shaft 126 and second lever 114*b*, and rotation of second lever 114*b* causes a corresponding rotation of cylindrical shaft 126 and first lever 114*a*.

First lever 114*a* may include a first shoulder 128*a*, and second lever 114*b* may include a second shoulder 128*b*. First shoulder 128*a* and second shoulder 128*b* may extend beyond the periphery of opening 118 to substantially cover air gaps between opening 118 and cylindrical shaft 126 at first side 116*a* and second side 116*b* of bushing 112. First shoulder 128*a* and second shoulder 128*b* may reduce of limit arcing that may occur in and around opening 118 of bushing 112.

First lever 114*a* and second lever 114*b* may be fabricated from a plastic, a resin, a polymer, nylon, or other similar material. In an example embodiment, first lever 114*a* and second lever 114*b* may be fabricated from Ultradur High Speed PBT. First lever 114*a* and second lever 114*b* may be fabricated by injection molding, machining, or other similar technique. First lever 114*a* may have a length between about 12 mm and about 22 mm, a width between about 3 mm and about 6 mm, and a height between about 4 mm and about 6 mm. Second lever 114*b* may have a length between about 10 mm and about 20 mm, a width between about 3 mm and about 6 mm, and a height between about 4 mm and about 6 mm. Persons of ordinary skill in the art will understand that other materials, fabrication techniques and dimensions may be used.

Figure 2A:
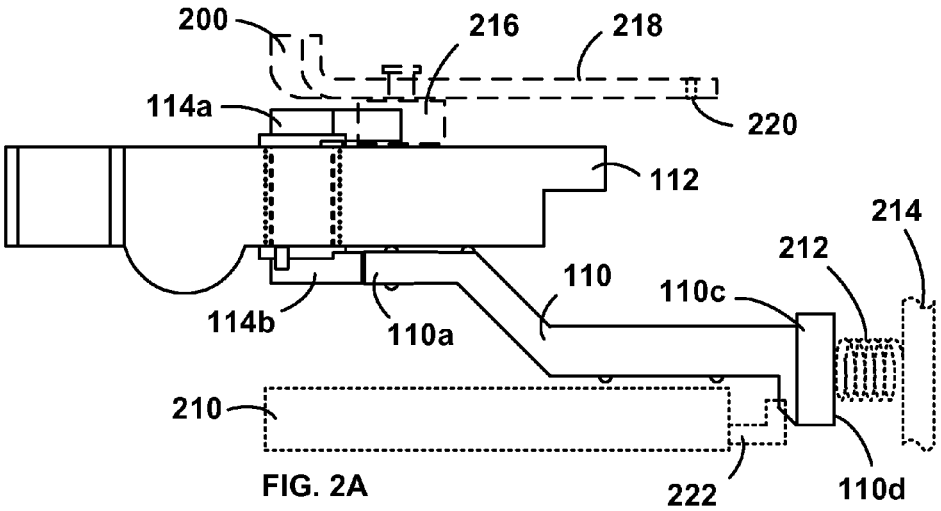
FIG. 2A is a top view of an example linkage in accordance with an embodiment of the invention with a circuit breaker in a non-tripped condition.
Figure 2B:
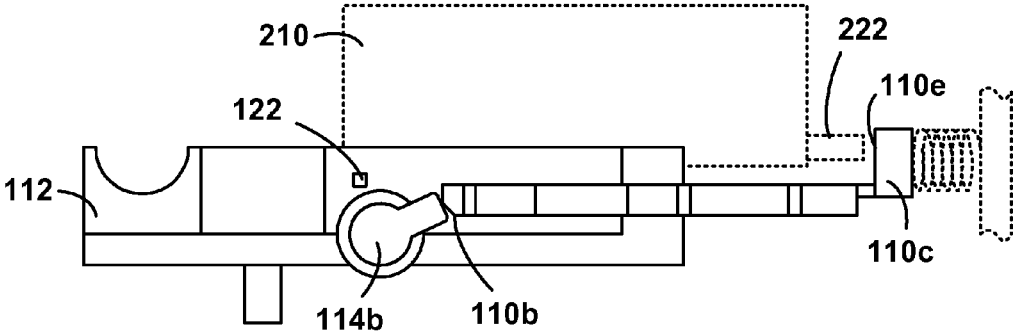
FIG. 2B is a side view of the example linkage of FIG. 2A.
Figure 2C:
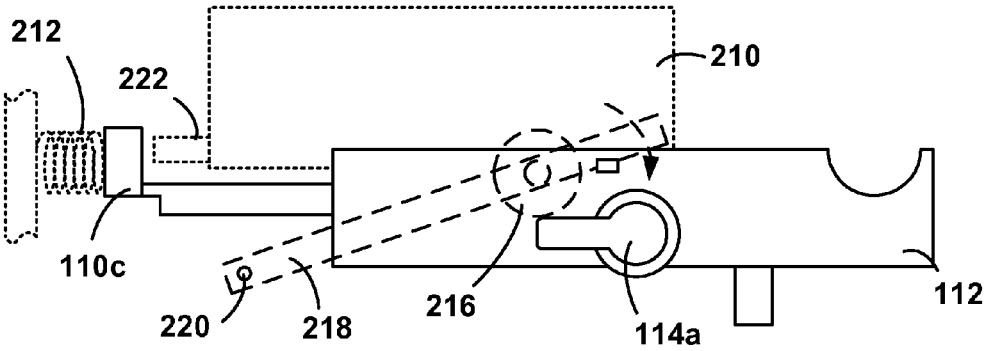
FIG. 2C is another side view of the example linkage of FIG. 2A.

Referring now to FIGS. 2A-2C, an example configuration of device 100 in a circuit breaker is described. FIGS. 2A-2C depict device 100 installed in a circuit breaker that is in the "ON" (non-faulted) condition. To simplify the drawings, only a few portions of circuit breaker components are included. Device 100 is coupled to a circuit breaker actuator (a "roller-on-cradle" structure 200), a circuit breaker accessory 210, and a spring 212 disposed between device 100 and circuit breaker housing 214. Although not shown in FIGS. 2A-2C, device 100 may be installed so that bushing 112 and linkage 110 are located on and disposed between one or more portions of circuit breaker housing and/or other components or features in the circuit breaker assembly.

Roller-on-cradle structure 200 is coupled to the circuit breaker trip unit (not shown), and includes a roller 216 that is mounted to a cradle 218, which is disposed on a pivot point 220. When the circuit breaker is "ON," roller-on-cradle structure 200 is biased downwardly about pivot point 220, and is disposed as shown in FIGS. 2A and 2C.

Accessory 210 may be a trip alarm switch, a auxiliary switch (AUX-switch), a remote actuation switch, or other similar circuit breaker accessory. Accessory 210 includes an actuation mechanism 222, which may be a switch, a push-button, a plunger, a micro-switch, a rotary arm (sometimes also called a rotating arm, a rotary lever, or a rotating lever), a cam, or other similar actuation mechanism that is configured to activate the accessory. In some embodiments, actuation mechanism 222 may be a spring-loaded plunger, and accessory 210 may be activated by depressing plunger 222, and may be deactivated by releasing plunger 222. For example, if accessory 210 is a trip alarm switch, depressing actuation mechanism 222 will cause the alarm to sound, and releasing actuation mechanism 222 will silence the alarm.

Although accessory 210 is depicted in FIGS. 2A-2C as a single circuit breaker accessory, persons of ordinary skill in the art will understand that devices and methods in accordance with embodiments of the invention may be used with more than one accessory, such as double accessories, and/or multiple single accessories.

First lever 114*a* of device 100 is disposed adjacent roller-on-cradle structure 200, second lever 114*b* is coupled to first end 110*a* of linkage 110, second end 110*c* of linkage 110 is disposed adjacent actuation mechanism 222 of accessory 210, and spring 212 is disposed between second surface 110*d* of linkage 110 and circuit breaker housing 214. As shown in FIGS. 2A and 2C, when the circuit breaker is "ON," roller 216 is coupled to first lever 114*a*, and linkage 110 is in a first position, in which second end 110*c* of linkage 110 does not contact actuation mechanism 222.

In particular, when the circuit breaker is "ON," roller-on-cradle structure 200 is biased downwardly, causing roller 216 to contact first lever 114*a* and bias first lever 114*a* in a counter-clockwise direction. Because first lever 114*a* and second lever 114*b* are fixedly coupled together, second lever 114*b* is biased in a clockwise direction, and pushes against first surface 110*b* of linkage 110. The biasing force of roller-on-cradle structure 200 is greater than the biasing force of spring 212. As a result, second end 110*c* of linkage 110 compresses spring 212, and third surface 110*e* of linkage 110 is separated from and does not contact actuation mechanism 222.

In response to an over-current and/or a short circuit condition, the circuit breaker trips, and roller-on-cradle structure 200 is biased upwardly about pivot point 220. In particular, roller-on-cradle structure 200 moves in a first (e.g., vertical) direction. As a result, roller 216 disengages from first lever 114*a*, removing the biasing force of roller-on-cradle structure 200 from first lever 114*a*.

In addition, spring 212 pushes against second end 110*c* of linkage 110, and linkage 110 moves in a second (e.g., horizontal) direction different from the first (e.g., vertical) direction from the first position to a second position. First end 110*a* of linkage 110 pushes against second lever 114*b*, which rotates in a third (e.g., counterclockwise) direction, and first lever 114*a* rotates in a fourth (e.g., clockwise) direction.

Figure 3A:
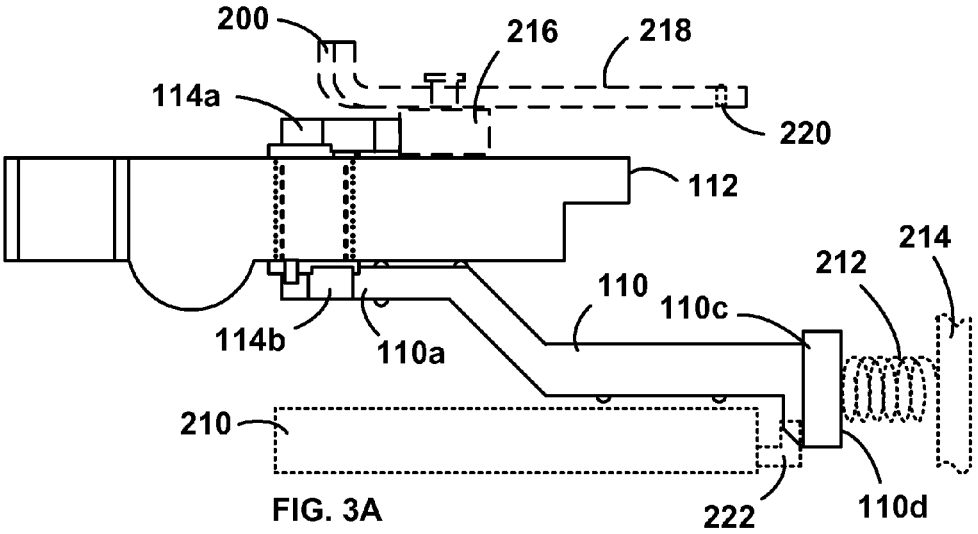
FIG. 3A is a top view of an example linkage in accordance with an embodiment of the invention with a circuit breaker in a tripped condition.
Figure 3B:
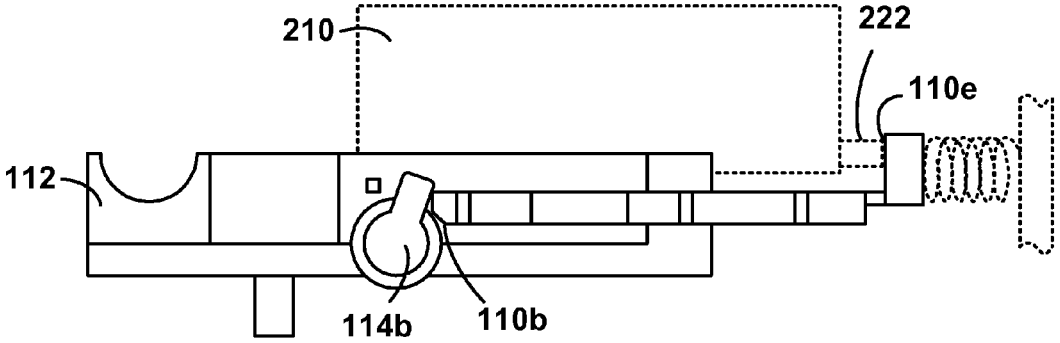
FIG. 3B is a side view of the example linkage of FIG. 3A.
Figure 3C:
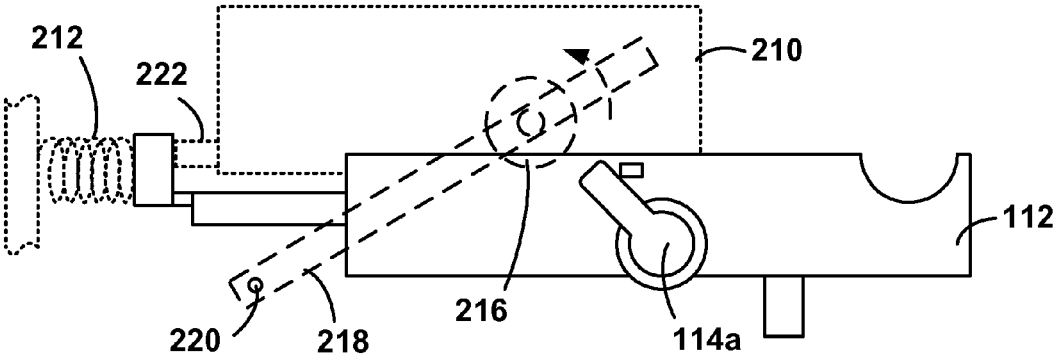
FIG. 3C is another side view of the example linkage of FIG. 3A.

FIGS. 3A-3C illustrate the configuration of device 100 and roller-on-cradle structure 200 following a trip event. With linkage 110 in the second position, second end 110*c* of linkage 110 contacts actuation mechanism 222 to activate accessory 210. For example, third surface 110*e* of linkage 110 makes engaging contact with and depresses actuation mechanism 222. If accessory 210 is a trip alarm switch, this causes the trip alarm switch to emit an audible alarm to alert personnel that the circuit breaker has tripped.

As described above, bushing 112 may include an optional travel limiter 122, which may be used to limit the counter-clockwise rotation of second lever 114*b*. This in turn limits further movement of linkage 110 in the second (e.g., horizontal) direction. As shown in FIGS. 3A-3C, travel limiter 122 may be a tab that projects from second side 116*b* of bushing 112. The height of tab 122 may be set to prevent further counterclockwise rotation of second lever 114*b*, and further movement of linkage 110. Persons of ordinary skill in the art will understand that other types of travel limiters 122 may be used. For example, travel limiter 122 alternatively may be a recess formed in second side 116*b* of bushing 112, with a shape design to obstruct further counterclockwise rotation of second lever 114*b*.

Figure 4A:
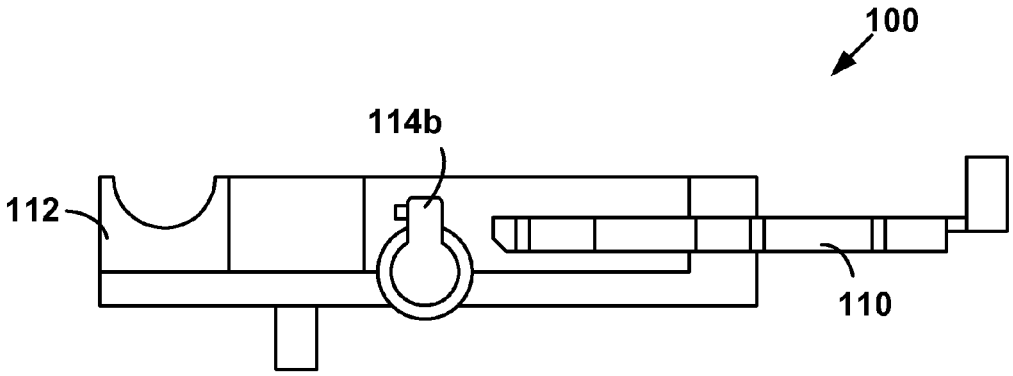
FIG. 4A is a side view of the example linkage of FIG. 1A in an installation configuration.
Figure 4B:
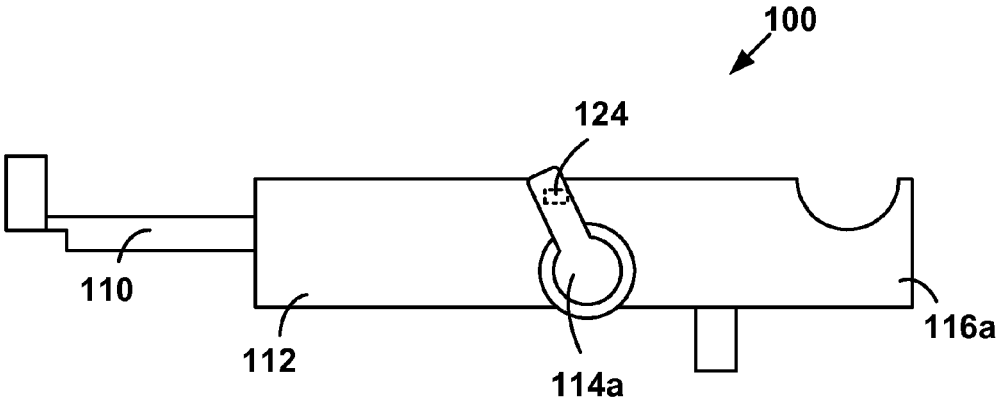
FIG. 4B is another side view of the example linkage of FIG. 4A.

As described above, bushing 112 may optionally include a stop 124, the features of which are illustrated in FIGS. 4A-4B. Stop 124 may be a tab that projects from first side 116*a* of bushing 112. Stop 124 may have a height to act as a wedge to hold first lever 114*a* (and thereby hold second lever 114*b*) in a fixed position. For example, stop 124 may be located on bushing 112 so that second lever 114*a* is held in a fixed vertical orientation (e.g., in a 12 o'clock position) to allow linkage 110 to be easily inserted and removed from the circuit breaker, such as during assembly and/or disassembly. Persons of ordinary skill in the art will understand that stop 124 may have configurations and profiles other than as shown in FIGS. 4A-4B.

The foregoing merely illustrates the principles of and embodiments of the invention, and various modifications can be made by persons of ordinary skill in the art without departing from the scope and spirit of the invention.

For example, persons of ordinary skill in the art will understand that more than one device in accordance with embodiments of the invention may be used in a circuit breaker. As described above, some existing circuit breakers include more than one accessory compartment. Accordingly, persons of ordinary skill in the art will understand that multiple devices in accordance with embodiments of the invention may be used with such circuit breakers, with one device per accessory compartment.

The invention claimed is:

1. A device for use with a circuit breaker and a circuit breaker accessory, the circuit breaker including an actuator configured to move in a first direction in response to at least one of an over-current and a short circuit condition and the circuit breaker accessory including an actuation mechanism, the device comprising:

a linkage including a first end configured to be coupled to the actuator and a second end configured to be disposed adjacent the actuation mechanism, a first lever configured to be disposed adjacent the actuator; and a second lever coupled to the first lever and coupled to the first end of the linkage;

wherein movement of the actuator in the first direction allows the linkage to move in a linear second direction different from the first direction, from a first position to a second position, to activate the circuit breaker accessory; and wherein when the linkage moves from the first position to the second position, the second lever rotates in a third direction, and the first lever rotates in a fourth direction.

2. The device of claim 1, wherein:

when the linkage is in the first position, the second end does not contact the actuation mechanism; and when the linkage is in the second position, the second end contacts the actuation mechanism.

3. The device of claim 2, wherein when the linkage is in the second position, the second end depresses the actuation mechanism to activate the circuit breaker accessory.

4. The device of claim 1, wherein the second end of the linkage comprises a surface configured to make engaging contact with the actuation mechanism.

5. The device of claim 1, further comprising:

a spring coupled to the second end of the linkage, wherein the spring is configured to bias the second end of the linkage toward the actuation mechanism.

6. The device of claim 1, wherein the second end of the linkage is configured to be disposed adjacent a plurality of actuation mechanisms of a plurality of circuit breaker accessories.

7. The device of claim 1, wherein the device is configured to be used with a trip alarm switch accessory.

8. The device of claim 1, wherein the actuation mechanism comprises one or more of a switch, a push-button, a plunger, a micro-switch, a rotary arm, and a cam.

9. A modular accessory for use with a circuit breaker, the circuit breaker including an actuator configured to move in a first direction in response to at least one of an over-current and a short circuit condition, the modular accessory comprising:

an actuation mechanism;

a linkage including a first end configured to be coupled to the actuator and a second end disposed adjacent the actuation mechanism, and a spring coupled to the second end of the linkage, wherein the spring is configured to bias the second end of the linkage toward the actuation mechanism;

wherein movement of the actuator in the first direction allows the linkage to move in a linear second direction different from the first direction, from a first position to a second position, to activate the modular accessory.

10. The modular accessory of claim 9, wherein:

when the linkage is in the first position, the second end does not contact the actuation mechanism; and when the linkage is in the second position, the second end contacts the actuation mechanism.

11. The modular accessory of claim 10, wherein when the linkage is in the second position, the second end depresses the actuation mechanism to activate the circuit breaker accessory.

12. The modular accessory of claim 9, wherein the second end of the linkage comprises a surface configured to make engaging contact with the actuation mechanism.

13. The modular accessory of claim 9, further comprising:

a first lever configured to be disposed adjacent the actuator; and a second lever coupled to the first lever and coupled to the first end of the linkage.

14. The modular accessory of claim 13, wherein when the linkage moves from the first position to the second position, the second lever rotates in a third direction, and the first lever rotates in a fourth direction.

15. The modular accessory of claim 9, wherein the second end of the linkage is configured to be disposed adjacent a plurality of actuation mechanisms of a plurality of circuit breaker accessories.

16. The modular accessory of claim 9, further comprising:

a trip alarm switch accessory.

17. The modular accessory of claim 9, wherein the actuation mechanism comprises one or more of a switch, a push-button, a plunger, a micro-switch, a rotary arm, and a cam.

18. A circuit breaker comprising:

an actuator configured to move in a first direction in response to at least one of an over-current and a short circuit condition;

a circuit breaker accessory including an actuation mechanism;

a linkage including a first end coupled to the actuator and a second end disposed adjacent the actuation mechanism, a first lever configured to be disposed adjacent the actuator; and a second lever coupled to the first lever and coupled to the first end of the linkage;

wherein movement of the actuator in the first direction allows the linkage to move in a linear second direction different from the first direction, from a first position to a second position, to activate the circuit breaker accessory, and wherein when the linkage moves from the first position to the second position, the second lever rotates in a third direction, and the first lever rotates in a fourth direction.

19. The circuit breaker of claim 18, wherein:

when the linkage is in the first position, the second end does not contact the actuation mechanism; and when the linkage is in the second position, the second end contacts the actuation mechanism.

20. The circuit breaker of claim 19, wherein when the linkage is in the second position, the second end depresses the actuation mechanism to activate the circuit breaker accessory.

21. The circuit breaker of claim 18, wherein the second end of the linkage comprises a surface configured to make engaging contact with the actuation mechanism.

22. The circuit breaker of claim 18, further comprising:

a spring coupled to the second end of the linkage, wherein the spring biases the second end of the linkage toward the actuation mechanism.

23. The circuit breaker of claim 18, wherein the second end of the linkage is disposed adjacent a plurality of actuation mechanisms of a plurality of circuit breaker accessories.

24. The circuit breaker of claim 18, wherein the circuit breaker accessory comprises a trip alarm switch accessory.

25. The circuit breaker of claim 18, wherein the actuation mechanism comprises one or more of a switch, a push-button, a plunger, a micro-switch, a rotary arm, and a cam.

26. A method for use with a circuit breaker and a circuit breaker accessory, the circuit breaker including an actuator configured to move in a first direction in response to at least one of an over-current and a short circuit condition, the accessory including an actuation mechanism, the method comprising:

providing a linkage including a first end coupled to the actuator and a second end configured to be disposed adjacent the actuation mechanism;

moving the linkage in a linear second direction different from the first direction, from a first position to a second position, to activate the circuit breaker accessory in response to movement of the actuator in the first direction; and biasing the second end of the linkage toward the actuation mechanism.

27. The method of claim 26, wherein the method further comprises:

causing the second end to not contact the actuation mechanism when the linkage is in the first position; and causing the second end to contact the actuation mechanism when the linkage is in second position.

28. The method of claim 27, wherein the method further comprises causing the second end to depress the actuation mechanism to activate the accessory when the linkage is in the second position.

29. The method of claim 26, wherein the second end of the linkage comprises a surface configured to make engaging contact with the actuation mechanism.

30. The method of claim 26, further comprising:

providing a first lever configured to be disposed adjacent the actuator; and providing a second lever coupled to the first lever and coupled to the first end of the linkage.

31. The method of claim 30, further comprising:

rotating the second lever in a third direction, and rotating the first lever in a fourth direction, wherein when the linkage moves from the first position to the second position.

32. The method of claim 26, further comprising:

disposing the second end of the linkage adjacent a plurality of actuation mechanisms of a plurality of circuit breaker accessories.

33. The method of claim 26, wherein the circuit breaker accessory comprises a trip alarm switch accessory.

34. The method of claim 26, wherein the actuation mechanism comprises one or more of a switch, a push-button, a plunger, a micro-switch, a rotary arm, and a cam.

35. A trip alarm switch accessory comprising the device of claim 1.

* * * * *